US005806719A

United States Patent [19]

Witty et al.

[11] Patent Number: 5,806,719

[45] Date of Patent: Sep. 15, 1998

[54] FITMENT BASED DISPENSING SYSTEM FOR A POUCH

[75] Inventors: Craig Witty, Winnetka; Craig Boyd, Mt. Prospect, both of Ill.

[73] Assignee: Tetra Laval Holdings & Finance, SA, Pully, Switzerland

[21] Appl. No.: 893,429

[22] Filed: Jul. 11, 1997

[51] Int. Cl.[6] ..... B65D 35/56

[52] U.S. Cl. ..... 222/105; 222/465.1

[58] Field of Search ..... 222/105, 183, 222/83.5, 465.1; 220/404

[56] References Cited

U.S. PATENT DOCUMENTS

| | | | |
|---|---|---|---|
| 1,951,515 | 3/1934 | Lyell . | |
| 2,297,375 | 9/1942 | Vogt . | |
| 2,571,798 | 10/1951 | Urch . | |
| 2,789,728 | 4/1957 | Britton . | |
| 2,831,610 | 4/1958 | Dennie . | |
| 2,872,081 | 2/1959 | Randall | 222/183 |
| 2,951,628 | 9/1960 | Grussen . | |
| 3,112,047 | 11/1963 | Weinreich et al. . | |
| 3,208,492 | 9/1965 | Braithwaite . | |
| 3,208,640 | 9/1965 | Paulson . | |
| 3,238,984 | 3/1966 | Shurtleff et al. . | |
| 3,255,932 | 6/1966 | Hunter et al. | 222/183 |
| 3,370,629 | 2/1968 | Neuman . | |
| 3,606,962 | 9/1971 | Scholle . | |
| 3,642,189 | 2/1972 | Widenback . | |
| 3,799,400 | 3/1974 | Fleury | 222/83.5 |
| 4,100,953 | 7/1978 | Miller . | |
| 4,454,979 | 6/1984 | Ikeda . | |
| 4,484,351 | 11/1984 | de Leeuwe et al. . | |
| 4,653,671 | 3/1987 | Duffy et al. . | |
| 4,738,546 | 4/1988 | Sengewald . | |
| 4,869,398 | 9/1989 | Colvin et al. . | |
| 4,911,562 | 3/1990 | Mazzeschi . | |
| 4,953,708 | 9/1990 | Beer et al. . | |
| 4,994,979 | 2/1991 | Strand et al. . | |
| 5,141,134 | 8/1992 | Machado . | |
| 5,378,065 | 1/1995 | Tobolka . | |
| 5,462,168 | 10/1995 | Oberhelam et al. | 222/105 |
| 5,558,438 | 9/1996 | Warr . | |

*Primary Examiner*—Philippe Derakshani
*Attorney, Agent, or Firm*—Michael A. Catania

[57] ABSTRACT

The system includes a rigid container having a fitment coupling, and a flexible pouch with a fitment thereon which is placed within a recess of the rigid container. The fitment has an annular attachment member which engages with a mating member on the fitment coupling. In this manner, the fitment is secured to the rigid container thereby allowing an user/consumer to dispense the contents of the flexible pouch by gripping the container. In an alternate embodiment, the rigid container permits the user to grasp the pouch to dispense the contents without raising the rigid container from a table. Various fitments may be employed in practicing the present invention such as flip cap, screw cap, tamper-proof fitments, and the like.

22 Claims, 8 Drawing Sheets

FITMENT BASED DISPENSING SYSTEM FOR A POUCH

BACKGROUND OF THE INVENTION

1. Field of the Invention

The present invention relates to the dispensing of flowable materials from a flexible pouch. Specifically, the present invention relates to a system for dispensing a flowable material from a flexible pouch which has been placed within a rigid container.

2. Description of the Related Art

Simple pouches used for flowable materials typically do not include an opening or a recloseable fitment. This creates problems when accessing the contents of the flexible pouch. Additionally, most flexible pouches are fabricated in such a manner as to prohibit self-standability. This further deters consumers from choosing flexible pouches over more traditional packages such as TETRA BRIK® parallelepiped containers or TETRA REX® gable top cartons.

The prior art has attempted to address this problem in several ways. Duffy et al, U.S. Pat. No. 4,653,671, for a Container, discloses a jug for pouring liquids from a flexible rectangular pouch which has been incised for access to the contents. Scholle, U.S. Pat. No. 3,606,962, for a Dispensing and Sealing Receptacle, discloses a pitcher for supporting and dispensing the contents of a bag which is opened through a non-recloseable pull tab. The opening of the bag is then placed within a slit on the pitcher for closure. Machado, U.S. Pat. No. 5,141,134, for a Pitcher With Spout, discloses a pitcher for shaping the pouch to the interior of the pitcher. The pouch is then pierced by a sleeve and spout to access the contents.

Consumers could readily just pour the contents into a standard pitcher without much difference from the prior art. What is needed is more than just a pitcher for supporting the pouch. What is needed is something that augments the flexible pouch, not substitutes for it.

BRIEF SUMMARY OF THE INVENTION

The present invention resolves the above-mentioned problems in a manner which augments the flexible pouch thereby allowing for the full potential of the flexible pouch to be utilized by a consumer. The present invention achieves this solution by providing a full system which supports the beneficial properties of a flexible pouch.

One aspect of the present invention is a system for dispensing a flowable material from a flexible pouch. The system includes a flexible pouch with a fitment attached thereon, a rigid container having a continuous wall defining a recess therein, and a handle or other easy-to-grip surface. The fitment has a hallow cylindrical projection portion and a recloseable cap. The system is characterized in that the rigid container has a fitment coupling with a mating member for engaging with the fitment which has an annular attachment thereon for such purposes. The flexible pouch having the fitment thereon is placed within the recess of the rigid container. The fitment is engaged with the fitment coupling through placement of the annular attachment member with the mating member thereby stabilizing the fitment and allowing for facilitated dispensing of the flowable material from the flexible pouch through operation of the handle.

The fitment may be a flip-cap fitment, a screw-cap fitment, or a simple annular ring intended to mate with an external spout which contains a piercing device. The rigid container may be sized to accommodate a flexible pouch having a predetermined capacity from 1 liter to 20 liters. The continuous wall of the rigid container may define a rectangular shaped recess, an elliptical shaped recess, or some other suitable geometry. The annular attachment member may be an annular protrusion, a channel, or a straight section of wall. The mating member may be a channel, a track, or edges which create a frictional attachment with the straight sides of the wall of the annular attachment member. The rigid container may further include a locking clip for insertion into the indentation above the fitment to further secure the fitment to the rigid container, or a positionable spout with piercing device which can open the pouch as well as provide a dispensing function.

It is a primary object of the present invention to provide a system for facilitating the pouring of a flowable material from a flexible container.

It is a further object of the present invention to provide a system for providing standability to a flexible pouch.

It is a further object of the present invention to provide a system applicable to various sizes and shapes of flexible pouches.

Having briefly described this invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

Several features of the present invention are further described in connection with the accompanying drawings in which:

There is illustrated in FIG. 1 a vertical cross-section view of a preferred embodiment of the system of the present invention.

Figure 2:
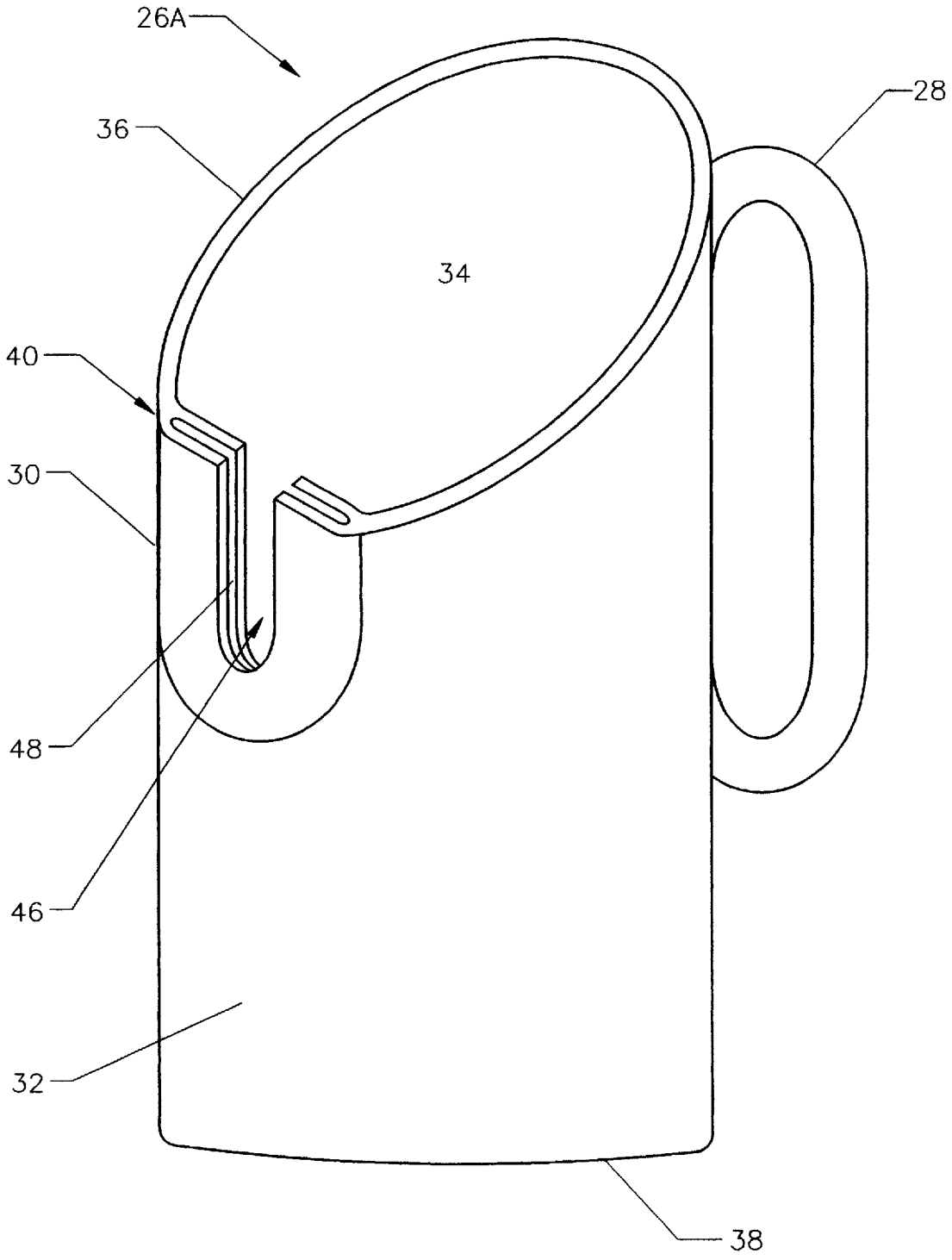

There is illustrated in FIG. 2 a perspective view of one embodiment of a container of the system for the present invention.

Figure 3:
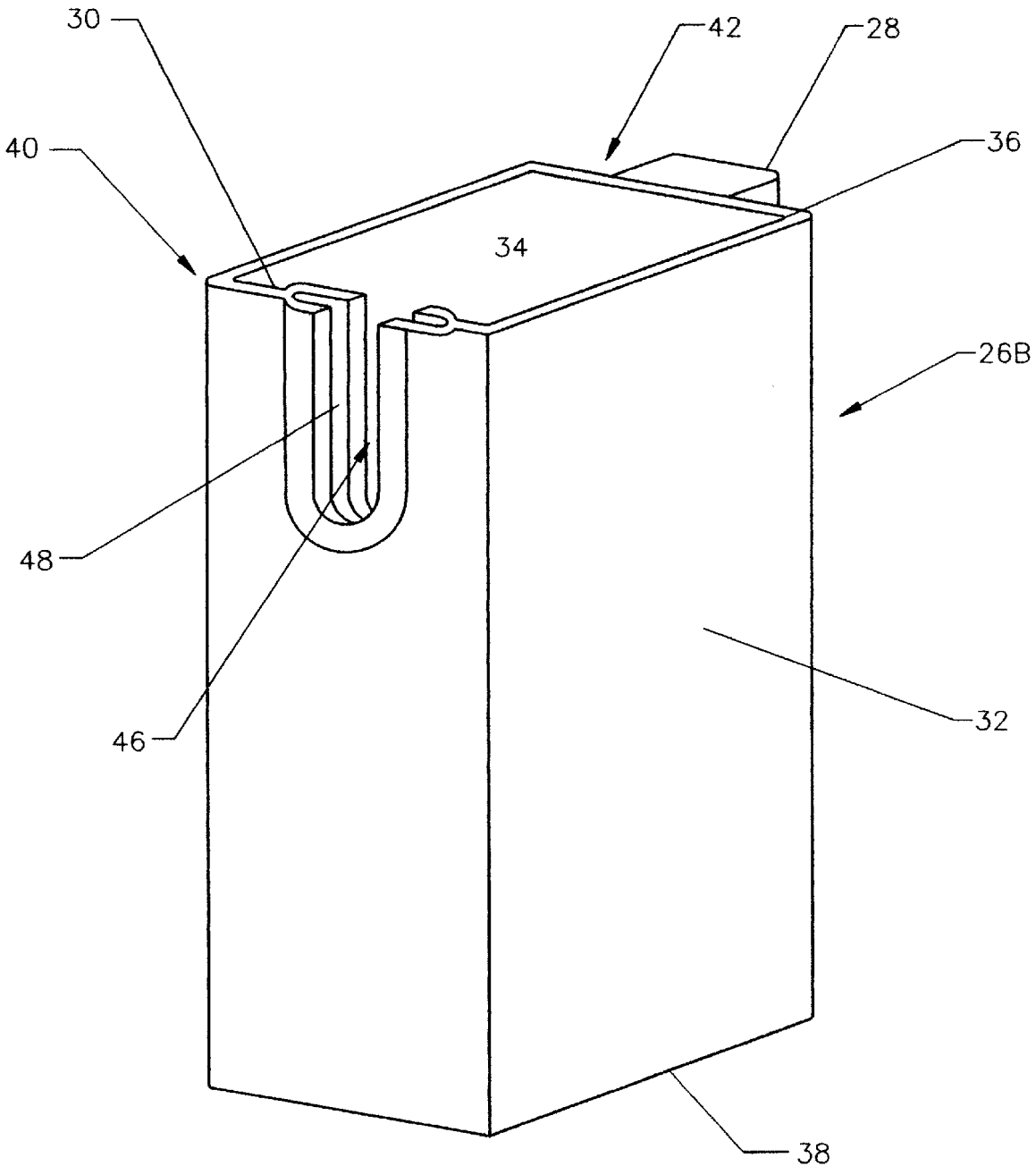

There is illustrated in FIG. 3 a perspective view of an alternative embodiment of a container of the system for the present invention.

Figure 4:
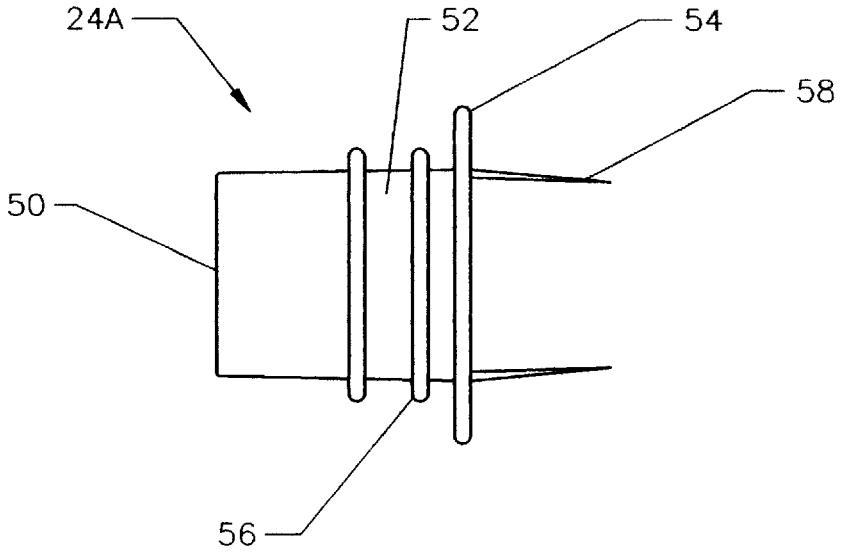

There is illustrated in FIG. 4 as side view of a screw cap fitment utilized in one embodiment of the system of the present invention.

Figure 5:
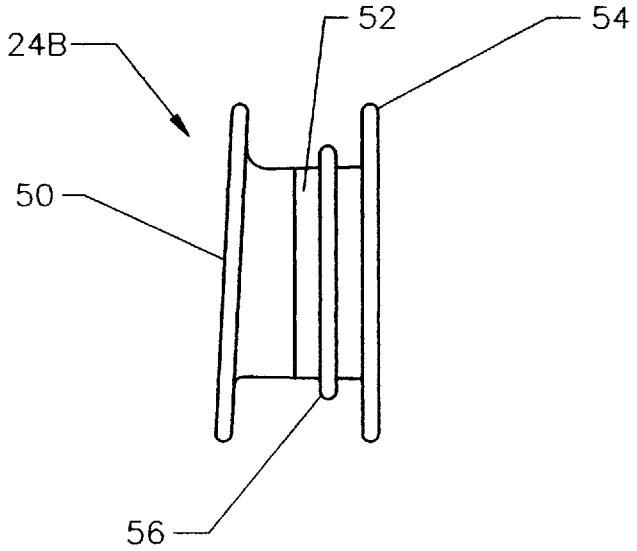

There is illustrated in FIG. 5 as side view of a flip cap fitment utilized in one embodiment of the system of the present invention.

Figure 6:
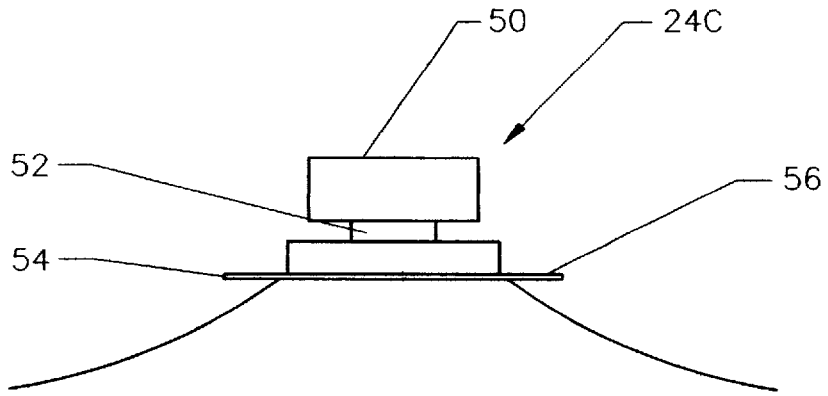

There is illustrated in FIG. 6 a side view of an alternative fitment utilized in the system of the present invention.

Figure 7:
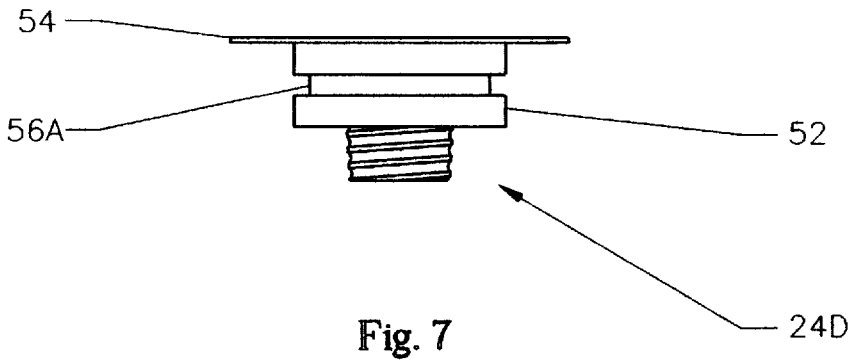

There is illustrated in FIG. 7 a side view of an another alternative fitment utilized in the system of the present invention.

Figure 8:
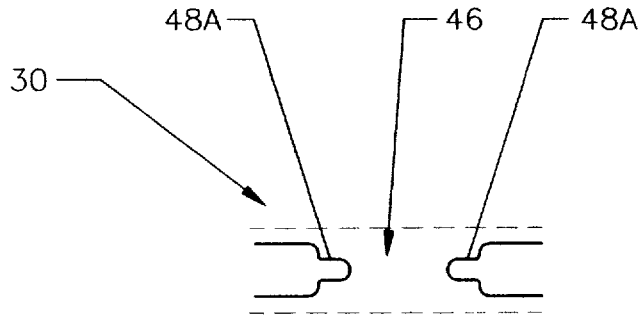

There is illustrated in FIG. 8 a top view of one embodiment of the fitment engagement coupling of the system of the present invention.

Figure 9:
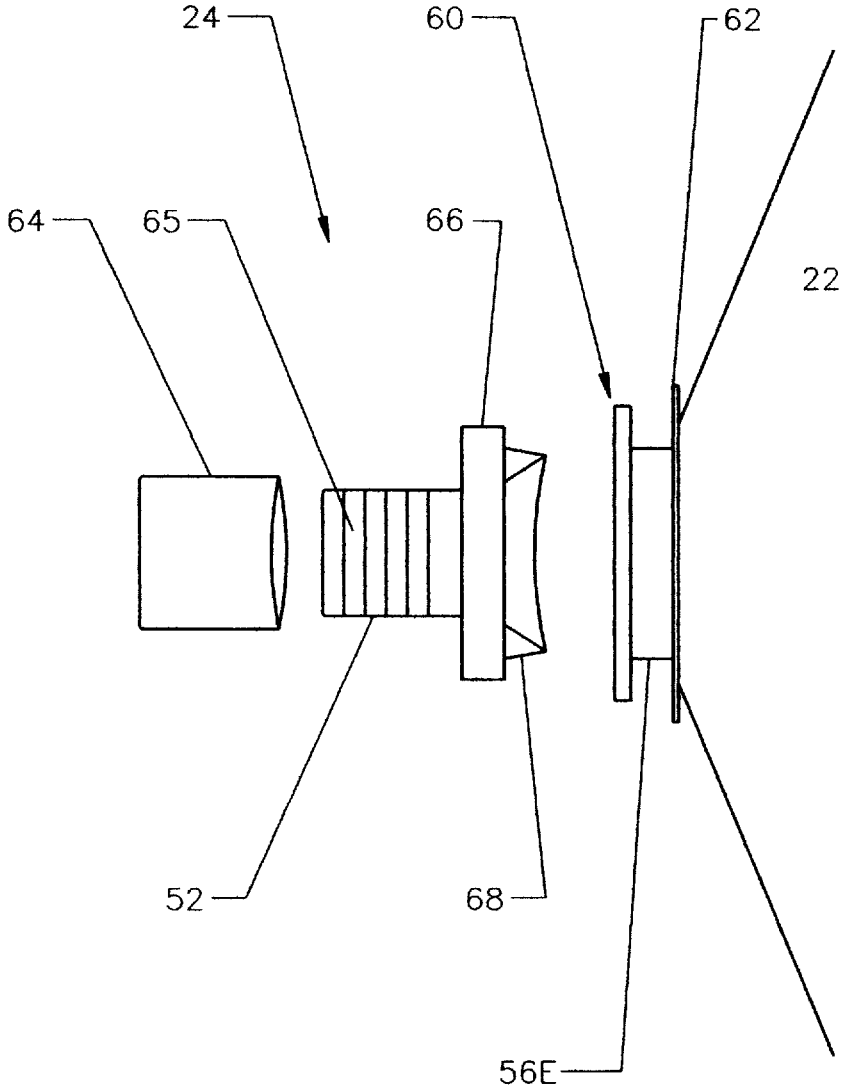

There is illustrated in FIG. 9 an exploded view of an alternative fitment of the system of the present invention.

Figure 10:
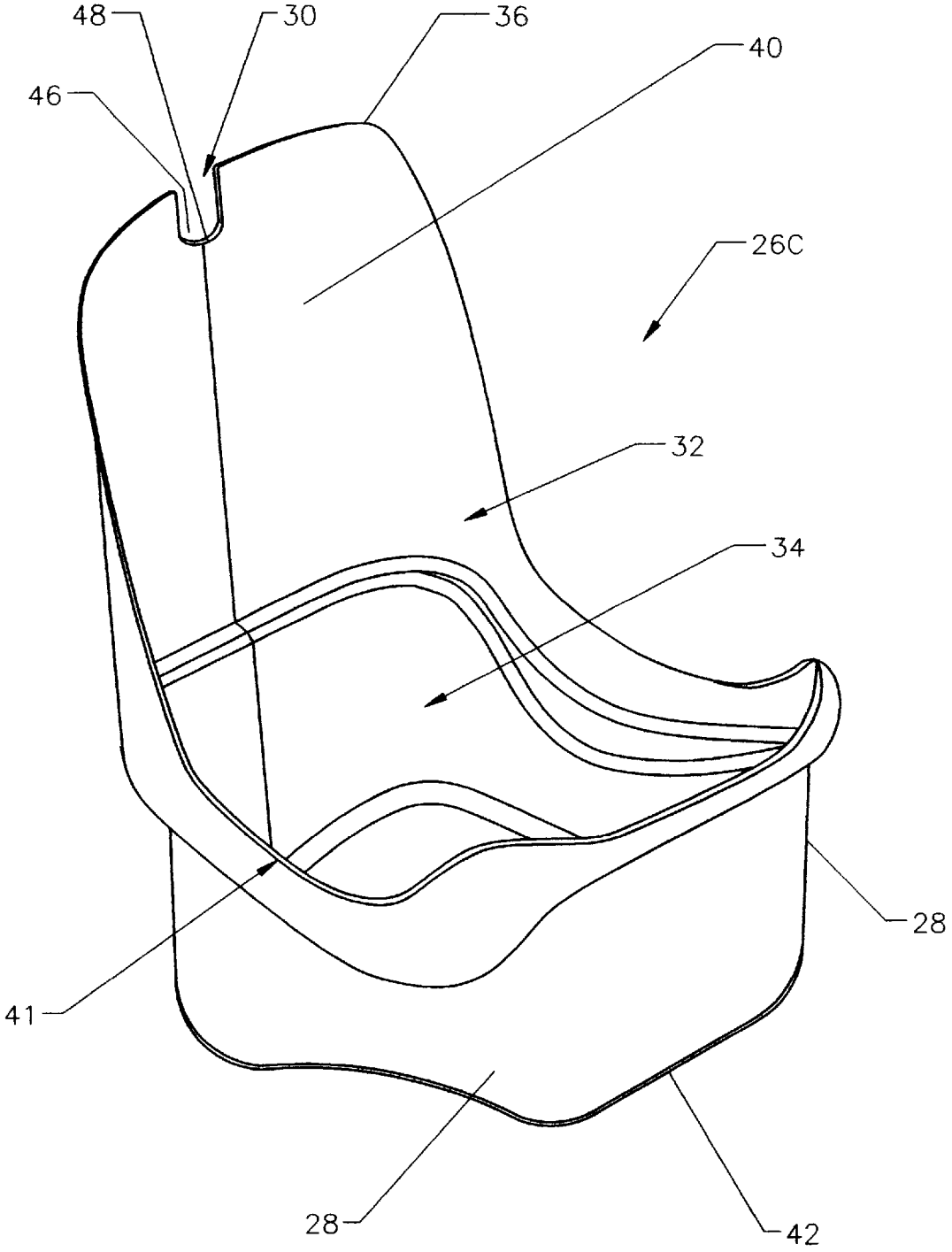

There is illustrated in FIG. 10 a perspective view of an alternative embodiment of a container of the system for the present invention.

Figure 11:
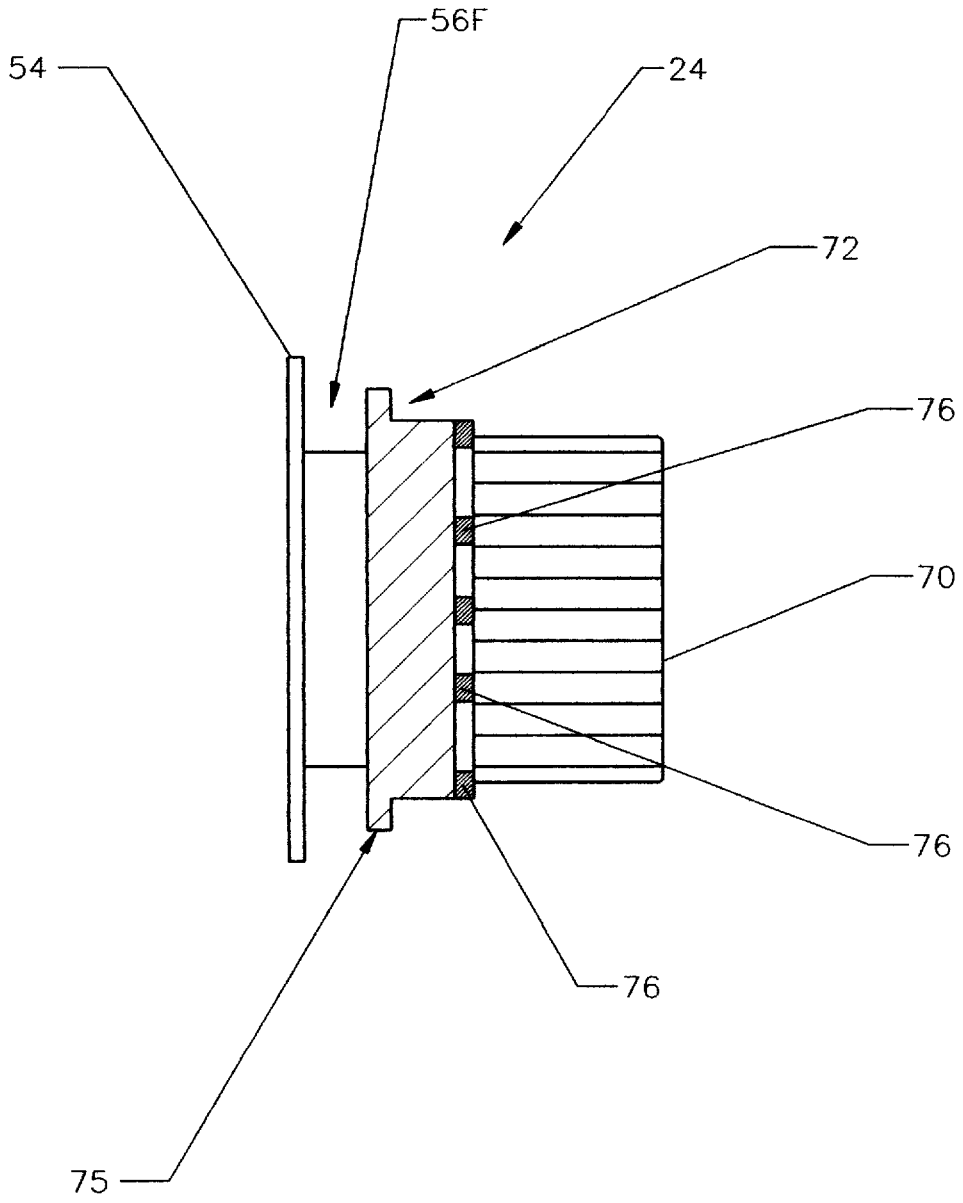

There is illustrated in FIG. 11 an alternate embodiment of the fitment of the present invention.

DETAILED DESCRIPTION OF THE INVENTION

The novel system of the present invention provides a consumer-friendly method of dispensing a flowable material from a flexible pouch. The novel system has universal application to flexible pouches of various shapes and sizes. The system provides a rigid structure for the flexible pouch in order give it standability. The system also allows for greater control of the outflow of the product by stabilizing the position of the fitment on the package in relation to the rigid container. Ideally, the flowable material would be water, juice or milk. However, other flowable materials may utilize the system of the present invention without departing from the scope or sprit of the claims.

Figure 1:
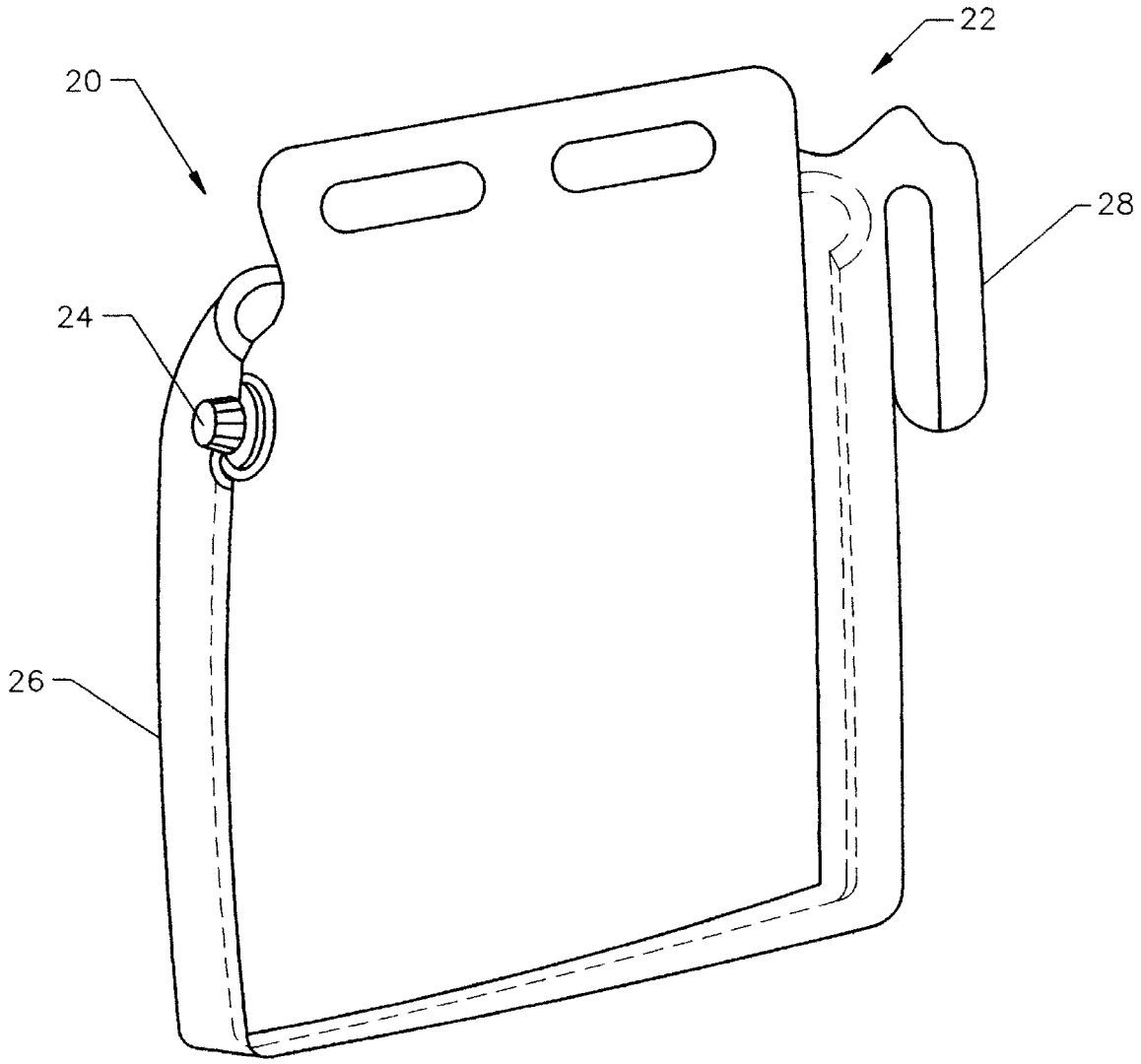

As shown in FIG. 1, a preferred embodiment of the system 20 is generally composed of a flexible pouch 22 with a fitment thereon 24, and a container 26 having a handle 28 and a fitment coupling 30. These basic components are applicable in various equivalents to most flexible pouches. A preferred range of pouches is from one liter to twenty liters, however, those skilled in the relevant art will recognize that the present invention may be utilized with other sizes without departing from the scope and content of the system of the present invention.

FIGS. 2 and 3 illustrate two different embodiments of the container 26 of the system 20 of the present invention. The containers 26A of FIG. 2 and 26B of FIG. 3, each have a fitment coupling 30, a continuous wall 32, a recess 34 and a handle or grippable surface 28. The continuous wall 32 is vertically defined by an upper boundary 36 and a lower boundary 38. The continuous wall 32 defines the recess 34 which has a pseudo-elliptical shape in FIG. 2 and a rectangular shape in FIG. 3. However, the continuous wall 32 may define a recess having various shapes including but not limited to square, octagonal, hexagonal, diamond, triangular, and the like. The recess 34 should be deep enough to accommodate the majority of the pouch 22 while allowing for engagement of the fitment 24 with the fitment coupling 30. For example, for a one liter pouch the recess 34 may have a volume of one liter. Similarly, a two liter pouch may have a two liter volume.

The container 26 has a dispensing end 40 and a gripping end 42. In most embodiments, the container 26 will have a flat bottom 44, however, those skilled in the relevant art will recognize that the container 26 may have non-flat bottoms without departing from the scope and content of the system of the present invention. The container is preferably made of a rigid material such as a rigid plastic material. However, other rigid materials such as metals, composites, woods and ceramics are within the scope of the present invention.

The fitment coupling 30 is located at the upper boundary 36 of the dispensing end 40 of the container 26. The fitment coupling 30 has an indentation 46 and a mating member 48. The mating member 48 may be a groove or channel as shown in FIGS. 2 and 3, or it may be a semi-annular protrusion as shown in FIG. 8. The mating member 48 engages with the fitment 24 of a flexible pouch 22 thereby restraining the movement of the fitment 24. The placement of the fitment 24 in the fitment coupling 30 also provides a counterforce to gravity in maintaining the flexible pouch 22 in an upright position within the container 26. The indentation 46 is shaped to allow placement of the entire fitment within the indentation 46.

FIGS. 4–7 illustrate various fitments which may be utilized in the present invention. The fitments 24 will all have the following components: a hallow cylindrical portion 52, a flange 54, and an annular attachment member 56 encompassing a portion of the hallow cylindrical portion 52. In the embodiment of the fitment 24 illustrated in FIG. 7, the flange 54 is the annular attachment member 56. In FIGS. 4–6, the annular attachment member 56 is an annular protrusion encompassing a portion of the hallow cylindrical portion 52. In FIG. 7, the annular attachment member 56A is an annular channel encompassing a portion of the hallow cylindrical portion 52. This particular embodiment illustrated in FIG. 7, is utilized with the fitment coupling 30 illustrated in FIG. 9. The fitment coupling 30 of FIG. 9 has an indentation 46 similar to the fitment couplings illustrated in FIGS. 2 and 3. However, the mating member 48A is a track defining the arcuate indentation 46. The track/mating member 48A engages with the channel/annular attachment member 56A to integrate the pouch 22 with the container 26. In the other embodiments illustrated in FIGS. 4–6, the annular attachment member 56 is an annular protrusion which engages with mating member 48 of FIGS. 2 and 3 which is an arcuate channel following from the shape of the indentation 46. Additionally, a hinged locking clip 60, not shown, may be employed on the top of the indentation 46 to securely fasten the fitment 24 to the fitment coupling 30 and thereby securely fastening the pouch 22 to the container 26.

In another embodiment illustrated in FIG. 9, an annular ring fitment 60 without a spout or cap, is attached to the outer surface of the pouch 22. The annular ring has a flange 62 and an annular attachment member 56E which mates with the fitment coupling 30. In this embodiment, an opening, not shown, is pre-punched in the pouch material. This opening is then covered with a patch of material, such as plastic-coated aluminum foil, or some other material which can be pierced more easily than normal pouch film. The annular ring 60 is applied to the outside of the pouch 22, over this patch. In use, an external, re-usable secondary fitment 24 with a spout/cap end 64 and a piercing end 68 is introduced into the space within the primary annular ring fitment 60. As the piercing end 68 cuts through the foil patch, the secondary fitment 24 is snapped or twisted to create a firm connection with the primary ring fitment 60 through engagement of engagement member 66 with annular ring fitment 60. The fitment 24 also has a hallow cylindrical portion 52 which has threads 65 for placement of the cap 64 thereon. The advantage of such an arrangement lies in the fact that the primary annular ring, which will be dispensed of with the pouch 22 after the contents have been removed, can be manufactured with a minimal amount of material, while the re-usable secondary fitment 24 provides a high level of convenience with a pouring spout and cap.

As shown in FIG. 10, the container 26C has a minimal continuous wall 32 to reduce the amount of material for the rigid container 26C, and to allow for the pressure dispersion of the contents of the pouch 22. The dispensing end 40 of the continuous wall 32 is of a similar height as in the other embodiments illustrated in FIGS. 2 and 3. However, the central portion 41 and the gripping end 42 of the continuous wall 32 are of a minimal height. The height of the gripping end 42 and the central portion 41 of the continuous wall 32 is sufficient to create a recess 34 for the various sizes of flexible pouches 22 to be utilized with the system 20. This descending curve shape of the container 26C allows for a user to squeeze a pouch 22 placed therein in order to dispense the contents of the pouch 22. In this manner, the system does not need to be tilted in order to dispense the contents of the pouch 22. The container may be resting on a table, and the user may bring a glass upwards to the fitment 24 for dispensing the contents of the pouch 22. This is necessary when the pouch 22 is more than four liters in capacity and is filled with a contents.

The fitment coupling 30 is similar to the fitment coupling 30 illustrated in FIGS. 2 and 3. The fitment coupling 30 is located at the upper boundary 36 of the dispensing end 40 of the container 26C. An indentation 46 is provided, and the mating member 48 may 20 be a track or a channel.

There is illustrated in FIG. 11 an alternate embodiment of the fitment of the present invention. As shown in FIG. 11, the fitment 24 has a screw cap 70 a captured tamper evident ring 72, an annular attachment member 56F and a flange 54. The tamper evident ring 72 has a plurality of tabs 76 connecting the cap 70 to the tamper evident ring 72 and a flange 75. When the cap 70 is opened for the first time, the connection is broken, however, the ring remains attached to the fitment 24. In this manner, the user/consumer will be able to determine if the contents of the pouch have been accessed previously. This will also deter counterfeiting of the pouch by those who would refill a previously used pouch with contents not originating from the producer of the original contents.

In practicing the system 20 of the present invention, a flexible pouch 22 is placed the recess 34 of a container 26. The annular attachment member 56 of the fitment 24 is engaged with the mating member 48 of the fitment coupling 30. Once the fitment 24 is securely inserted into the fitment coupling 30, the recloseable cap 50 is opened. The user then grasps the handle 28 and pours the flowable material into a receptacle, not shown, for ultimate consummation. In this manner, the system 20 allows for the flexible pouch 22 to be utilized similar to dispensing packages that have self-standability.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims:

We claim as our invention:

1. A system for dispensing a flowable material from a flexible pouch, the system comprising:

a fitment connected to the flexible pouch, the fitment having a hallow cylindrical projection portion and a recloseable cap, the hallow cylindrical portion having an annular attachment member thereon; and a rigid container, the rigid container having a continuous wall having an upper and lower boundary, the continuous wall defining a recess having a predetermined depth extending from the upper boundary to the lower boundary for placement of the flexible pouch therein, the rigid container having a dispensing end and a gripping end opposite the dispensing end, the rigid container having a fitment coupling encompassing an indentation at the upper boundary of the dispensing end, the fitment coupling having a mating member for engagement with the annular attachment member of the fitment; whereby the flexible pouch having the fitment thereon is placed within the recess of the rigid container with the fitment engaged with the fitment coupling through placement of the annular attachment member with the mating member thereby allowing for facilitated dispensing of the flowable material from the flexible pouch through operation of the gripping end.

2. The system according to claim 1 wherein the fitment is a flip-cap fitment.

3. The system according to claim 1 wherein the fitment is a screw-cap fitment.

4. The system according to claim 1 wherein the rigid container is sized to accommodate a flexible pouch having a predetermined capacity, the flexible pouch varying in capacity from 1 liter to 20 liters.

5. The system according to claim 1 wherein the continuous wall of the rigid container defines a rectangular shaped recess.

6. The system according to claim 1 wherein the continuous wall of the rigid container defines an elliptical shaped recess.

7. The system according to claim 1 wherein the annular attachment member is an annular protrusion.

8. The system according to claim 1 wherein the mating member is a channel.

9. The system according to claim 1 wherein the rigid container further comprises a locking clip for insertion into the indentation above the fitment to further secure the fitment to the rigid container.

10. The system according to claim 1 wherein the fitment has a tamper evident ring which is retained thereon subsequent to accessing the contents of the pouch.

11. The system according to claim 1 wherein the gripping end of the continuous wall is lower than the dispensing end thereby allowing for the dispersion of the contents of the pouch through pressurization of the pouch by the gripping of the pouch by an user.

12. A system for facilitated dispersion of a flowable material from a flexible pouch, the system comprising:

a fitment having a hallow cylindrical portion, a flange for placement on the outside of a pouch, a releasable cap at one end of the cylindrical portion and a pouch integration portion for piercing the flexible pouch at another end, the hallow cylindrical portion having an annular attachment member thereon; and a rigid container, the rigid container having a continuous wall having an upper and lower boundary, the continuous wall defining a recess having a predetermined depth extending from the upper boundary to the lower boundary for placement of the flexible pouch therein, the rigid container having a dispensing end and a gripping end opposite the dispensing end, the rigid container having a fitment coupling encompassing an indentation at the upper boundary of the dispensing end, the fitment coupling having a mating member for engagement with the annular attachment member of the fitment; whereby the fitment pierces and is attached to the flexible pouch thereby allowing for the flexible pouch having the fitment thereon to be placed within the recess of the rigid container with the fitment engaged with the fitment coupling through placement of the annular attachment member with the mating member thereby allowing for facilitated dispensing of the flowable material from the flexible pouch through operation of the gripping end.

13. The system according to claim 12 wherein the fitment is a flip-cap fitment.

14. The system according to claim 12 wherein the fitment is a screw-cap fitment.

15. The system according to claim 12 wherein the rigid container is sized to accommodate a flexible pouch having a predetermined capacity, the flexible pouch varying in capacity from 1 liter to 20 liters.

16. The system according to claim 12 wherein the continuous wall of the rigid container defines a rectangular shaped recess.

17. The system according to claim 12 wherein the continuous wall of the rigid container defines a elliptical shaped recess.

18. The system according to claim 12 wherein the annular attachment member is an annular protrusion.

19. The system according to claim 12 wherein the mating member is a channel.

20. The system according to claim 12 wherein the rigid container further comprises a locking clip for insertion into the indentation above the fitment to further secure the fitment to the rigid container.

21. The system according to claim 12 wherein the fitment has a tamper evident ring which is retained thereon subsequent to accessing the contents of the pouch.

22. The system according to claim 12 wherein the gripping end of the continuous wall is lower than the dispensing end thereby allowing for the dispersion of the contents of the pouch through pressurization of the pouch by the gripping of the pouch by an user.

* * * * *